US010383444B1

(12) United States Patent
Parkins

(10) Patent No.: US 10,383,444 B1
(45) Date of Patent: Aug. 20, 2019

(54) CHIN AND ARM SUPPORTING DEVICE

(71) Applicant: Terah M. Parkins, Houston, TX (US)

(72) Inventor: Terah M. Parkins, Houston, TX (US)

( * ) Notice: Subject to any disclaimer, the term of this patent is extended or adjusted under 35 U.S.C. 154(b) by 109 days.

(21) Appl. No.: 15/789,467

(22) Filed: Oct. 20, 2017

Related U.S. Application Data

(60) Provisional application No. 62/410,667, filed on Oct. 20, 2016.

(51) Int. Cl.
*A47C 1/10* (2006.01)
*A47C 16/00* (2006.01)
*A47C 7/62* (2006.01)

(52) U.S. Cl.
CPC ..... *A47C 1/10* (2013.01); *A47C 7/62* (2013.01); *A47C 16/00* (2013.01)

(58) Field of Classification Search
CPC .. A45D 29/22; A47C 1/10; A47C 1/11; A47C 16/00; A47C 7/383; A47C 7/62
See application file for complete search history.

(56) References Cited

U.S. PATENT DOCUMENTS 245,639 A * 8/1881 Lay ..... A47C 7/383 297/394
681,494 A 6/1901 Chambers
1,260,929 A * 3/1918 Maxcy ..... A47C 7/383 297/394
2,172,178 A 9/1939 Rosenberg
3,929,309 A * 12/1975 De Vore ..... A47C 1/10 248/118
5,169,103 A * 12/1992 Jimenez ..... A45D 29/18 132/73
5,184,795 A * 2/1993 Sexton ..... A45D 29/22 132/73
6,270,160 B1 * 8/2001 Blake ..... A47C 16/00 297/393
7,673,836 B2 3/2010 Wallock
7,748,064 B2 * 7/2010 Hamilton ..... A47C 16/00 248/118
8,042,775 B1 10/2011 Gallegos
2007/0052275 A1 * 3/2007 Ghilzai ..... A47C 1/06 297/423.12
2007/0262208 A1 * 11/2007 Wallock ..... A47C 16/00 248/118
2012/0261965 A1 * 10/2012 Elizalde ..... A47C 1/10 297/391
2014/0033439 A1 * 2/2014 Berhanu ..... A47C 16/00 5/640

(Continued)

*Primary Examiner* — David R Dunn
*Assistant Examiner* — Christopher E Veraa
(74) *Attorney, Agent, or Firm* — Cramer Patent & Design, PLLC; Aaron R. Cramer

(57) ABSTRACT

An arm and chin support device for a user that is to be seated for an extended time period. The arm and chin support includes a lap support having a base for resting on the lap of a user. The base includes a first leg pad, a second leg pad, and an intermediate curved pad that joins the first and second leg pads together. A length adjustable central mast is pivotally attached to the intermediate curved pad. Also included is an arm support that is movably adjustable. The arm support includes a tubular member and an arm carrier for supporting an arm of a user. In addition, a chin support is pivotally attached to an upper end of the central mast.

20 Claims, 5 Drawing Sheets

(56) References Cited

U.S. PATENT DOCUMENTS

| | | | | |
|---|---|---|---|---|
| 2015/0201731 | A1* | 7/2015 | Le | A45D 29/22<br>132/73 |
| 2016/0081482 | A1* | 3/2016 | Schumacher | A47C 7/383<br>5/640 |
| 2016/0331126 | A1* | 11/2016 | Mills | B60N 2/806 |
| 2017/0354263 | A1* | 12/2017 | Houghson | F16M 11/28 |
| 2018/0084919 | A1* | 3/2018 | Rayburn | A47C 16/00 |

* cited by examiner

CHIN AND ARM SUPPORTING DEVICE

RELATED APPLICATIONS

The present invention was first described in and claims the benefit of U.S. Provisional Application No. 62/410,667 filed Oct. 20, 2016, the entire disclosures of which are incorporated herein by reference.

FIELD OF THE INVENTION

The presently disclosed subject matter is directed to chairs. More particularly it relates to an arm and chin support for a user who is to remain seated for an extended period of time.

BACKGROUND OF THE INVENTION

Those who patronize beauty salons and manicure salons are familiar with how long it can take to get one's hair done or to receive a high-quality manicure. Such procedures often require a customer to keep their head as straight as possible or that they sit still as long as they can or that they must hold their hands away from their body. Such procedural requirements are not only extremely tiresome for the customer but because the customer typically cannot do what is required of them for the required length of time the achieved results may not be optimal.

The foregoing problems very much relate to the elderly and disabled since they may find it impossible to maintain a fixed position for any extended length of time. Therefore, some elderly and disabled no longer frequent hair care or nail care salons, much to the detriment of their visual appearance.

Accordingly, there exists a need for a device that assists hair care and nail care salon customers in maintaining the proper position for the required time when receiving services. Such a device might enable almost any hair care procedure or manicure to take place without placing undue stress on the customer. Beneficially, such devices would be easy to use and suitable for being made available at low cost.

SUMMARY OF THE INVENTION

The principles of the present invention provide for devices that assist hair care and nail care salon customers to maintain the required position for the required period of time to optimally receive the services being rendered.

An arm and chin support device that is in accord with the present invention includes a lap support having a base for resting on the lap of a user. The base includes a first leg pad, a second leg pad, and an intermediate curved pad that joins the first and second leg pads together. A length adjustable central mast is pivotally attached to the intermediate curved pad. Also included is an arm support that is movably adjustable. The arm support includes a tubular member and an arm carrier for supporting an arm of a user. In addition, a chin support is pivotally attached to an upper end of the central mast.

In practice the base may be arcuate shaped and/or the first leg pad may be concave and/or cushioned. Also in practice the central mast will include a pivot block that is attached to the intermediate curved pad, a mast pivot that is attached to the pivot block, and a mast first member that pivots on the mast pivot relative to the intermediate curved pad.

In addition, there may be a tilt lever bar having a tilt lever aperture and which extends from the central mast, and a tilt bracket that is affixed to and which extends from the intermediate curved pad and which receives the tilt lever bar. A tilt clamp collar having a tilt adjustment screw can then be included. The tilt lever clamp collar is for selectively locking the tilt lever bar to the tilt bracket at a selected angle via the tile adjustment screw.

There also may be a mast first block for coupling the central mast to the tilt lever bar, and the tilt lever bar might have an arcuate end. An intermediate mast slide tube may extend upward from the mast first block. The intermediate mast slide tube may have an intermediate mast slide tube aperture, the intermediate mast adjustment tube may have a pin aperture, and there may be a first spring-biased pin which passes through the intermediate mast slide pin aperture and through the intermediate mast slide tube aperture so as to interconnected the intermediate mast slide tube and the intermediate mast adjustment tube.

A mast second block might be connected to the intermediate mast adjustment tube. If so there may be an upper mast adjustment tube having a pin aperture which extends upward from the mast second block and an upper mast slide tube having a pin aperture. The upper mast adjustment tube may also have a pin aperture and it may extend upward from the mast second block. Then, a second spring-biased pin can pass through the upper mast slide tube pin aperture and through the upper mast adjustment tube pin aperture so as to interconnected the upper mast adjustment tube and the upper mast slide tube.

Also included may be a rotatable chin pad pivot first half that is attached to the upper mast slide tube and a rotatable chin pad pivot second half that is also attached to the upper mast slide tube. If so, a pivot clamp screw that passes through the chin pad pivot second half and into the chin pad pivot first half can be used to selectively lock the chin pad pivot second half to the chin pad pivot first half and relative to the upper mast slide tube. A chin pad support block may be attached to the chin pad second half and the chin pad support block may be covered by an over-covering chin pad.

There may be a first horizontal tube that is attached to the mast second block and a second horizontal tube that is also attached to the mast second block. A first horizontal tube might be attached to the mast second block and a first arm carrier bracket may be attached to the first arm slide tube. If so a first arm carrier might be attached to the first arm carrier bracket. The first arm carrier can be configured to receive an arm of a user. In practice the first arm carrier should form an arcuate arm cradle.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
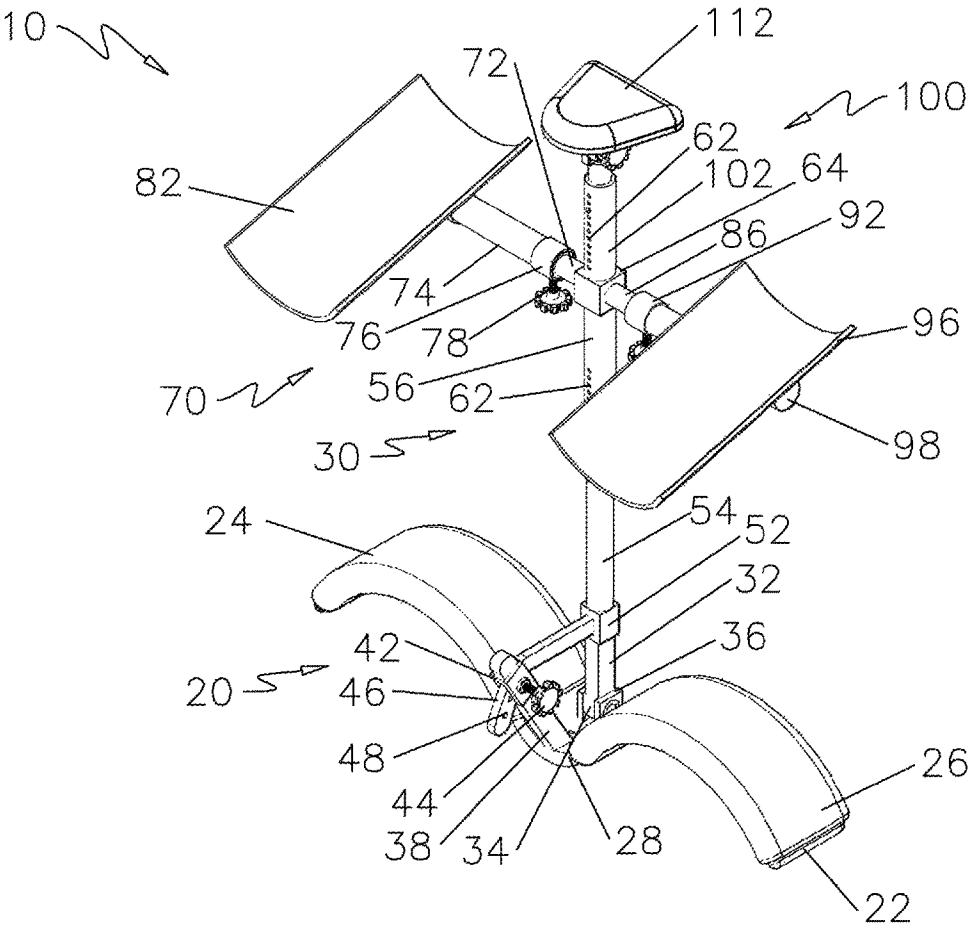
FIG. 1 is a perspective view of an arms and chin supporting device 10 that is in accord with the preferred embodiment of the present invention.

10 arm and chin supporting device
20 lap support
22 base
24 first leg pad
26 second leg pad
28 intermediate curved pad
30 central mast
32 mast first member
34 mast pivot
36 pivot block
38 tilt bracket
42 tilt clamp collar
44 tilt adjustment screw
46 tilt lever bar
48 tilt lever bar aperture
52 mast first block
54 intermediate mast slide tube
56 intermediate mast adjustment tube
58 first spring pin
62 pin aperture
64 mast second block
70 arm support
72 first horizontal tube
74 first arm slide tube
76 first slide tube collar
78 first arm adjustment screw
82 first arm carrier
84 first arm carrier bracket
86 second horizontal tube
88 second arm slide tube
92 second slide tube collar
94 second arm adjustment screw
96 second arm carrier
98 second arm carrier bracket
100 chin support
102 upper mast adjustment tube
104 upper mast slide tube
106 second spring pin
112 chin pad
114 chin pad support block
116 chin pad pivot
122 pivot first half
124 pivot second half
126 pivot clamp screw

DETAILED DESCRIPTION OF THE PREFERRED EMBODIMENT

The preferred embodiment of the present invention is depicted in FIGS. 1 through 5. However, the invention is not limited to the specifically described embodiment. A person skilled in the art will appreciate that many other embodiments of the invention are possible without deviating from the basic concept of the invention. Any such work around will also fall under the scope of this invention.

The terms "a" and "an" as used herein do not denote a limitation of quantity, but rather denote the presence of at least one (1) of the referenced items.

The present invention describes an arm and chin supporting device 10 (hereinafter "supporting device 10") which provides a supporting structure for the arms and head of a user while they relax while, for example, a cosmetologist performs a hair treatment or gives a manicure. Since the supporting device 10 is intended to be placed on a user's upper legs and to extend up to the same user's chin, some confusion may arise with a relative terminology such as distal and proximate. Therefore, in the ensuing discussion the directional signals related to "up" or "upper" refer to that portion of the supporting device 10 that is nearer the user's chin.

Figure 2:
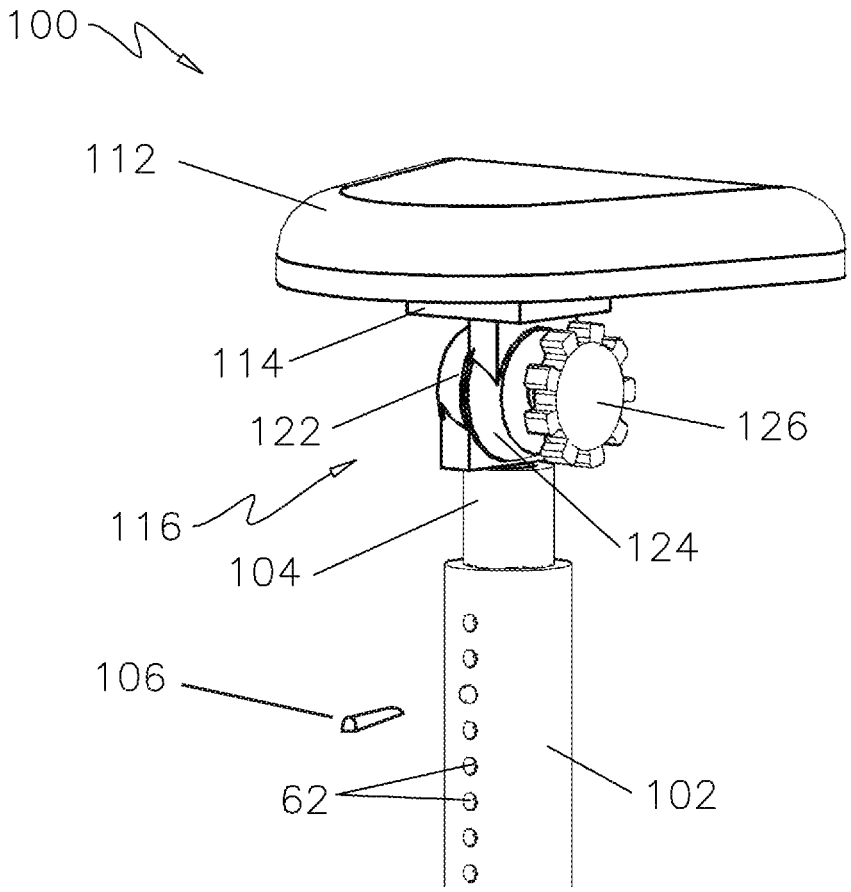
FIG. 2 presents an isolated view of a chin pad 112 and chin pad pivot 116 that are part of the arm and chin supporting device 10 shown in FIG. 1.
Figure 3:
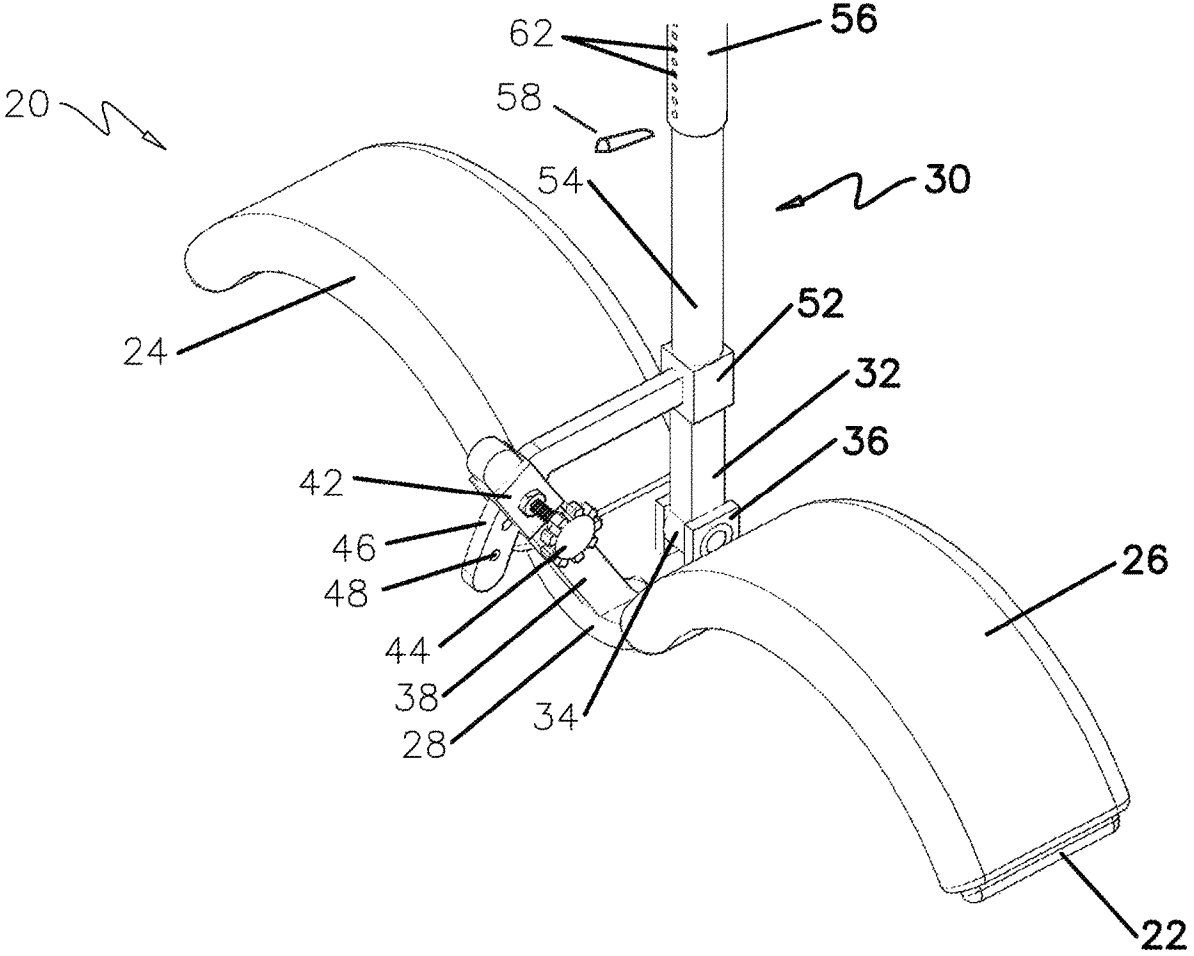
FIG. 3 is an isolated view of a lap support 20 and a mast pivot 34 that are part of the arm and chin supporting device 10 shown in FIG. 1.
Figure 4:
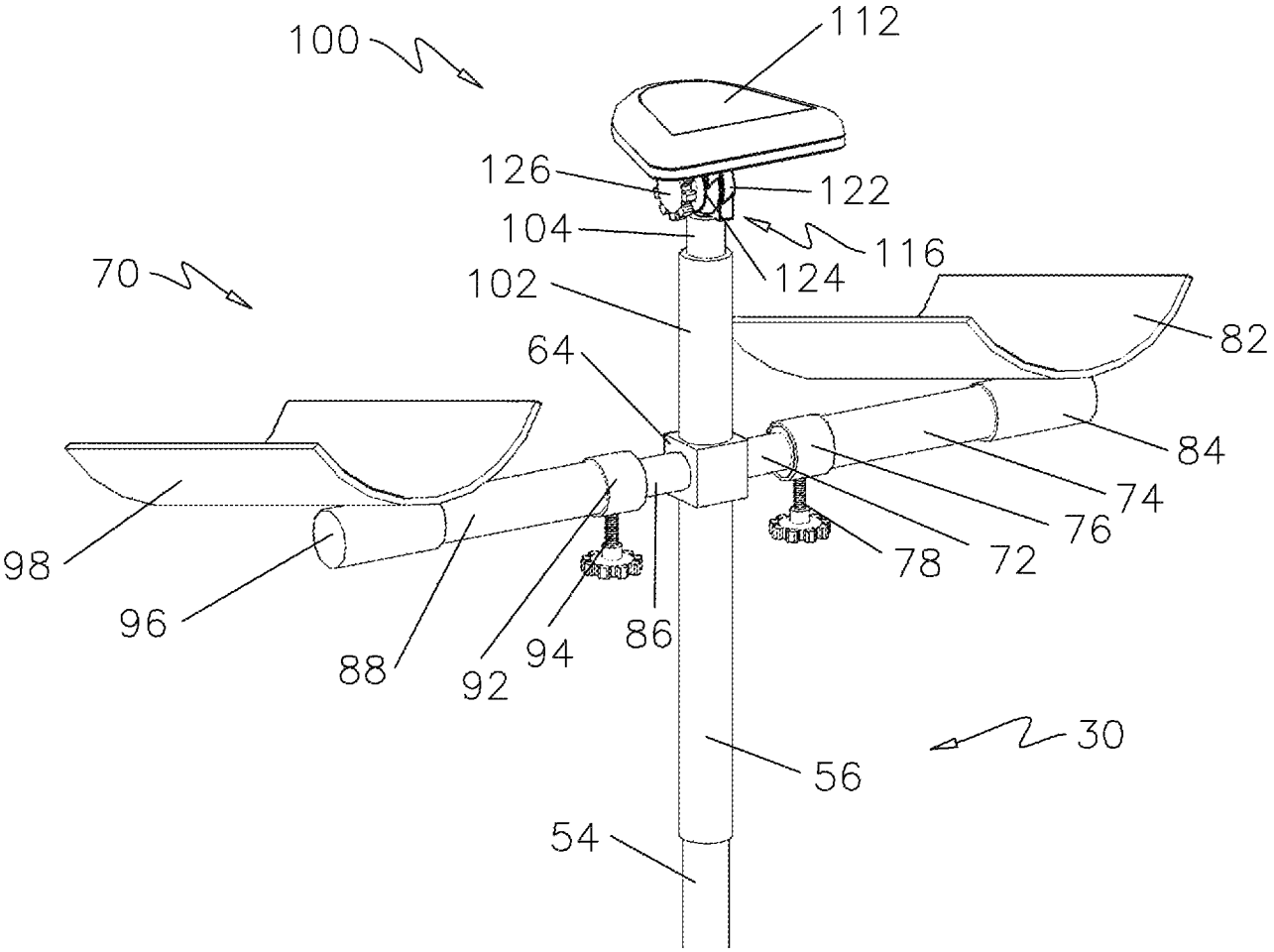
FIG. 4 is an isolated view from a user's perspective of an arm support 70 that is part of the arm and chin supporting device 10 shown in FIG. 1; and, FIG. 5 is a perspective view of the arm and chin supporting device 10 of FIG. 1 depicted in an exemplary tilt.

Refer now to FIG. 1 for a perspective view of the supporting device 10 and to FIGS. 2 through 4 for various views of isolated portions of the supporting device 10. The supporting device 10 includes a lap support 20, a central mast 30, an arm support 70, and a chin support 100. The lap support 20 includes a plurality of arcuate members forming a base 22 which is configured to be positionable over the upper legs of a seated user. The base 22 includes a concave first leg pad 24 and a concave second leg pad 26. The base 22 also includes an intermediate curved pad 28 that conjoins the leg pads 24 and 26.

The base 22 is beneficially comprised of a lightweight, rigid material such as aluminum. Alternatively, another material such as such as a rigid thermoplastic may be used. The first leg pad 24 and the second leg pad 26 are cushioned and bound within a textile cover (not enumerated). The cover may be presented in any acceptable texture and color as may suit the purpose of the supporting device 10 and the taste of a user.

The central mast 30 includes a mast first member 32, a mast first block 52, an interconnected intermediate mast slide tube 54 and intermediate mast adjustment tube 56, a mast second block 64, an interconnected upper mast slide tube 104 (reference FIG. 5) and an upper mast adjustment tube 102. The mast first member 32 is joined to, or is formed with, a mast pivot 34. The mast pivot 34 is a jointed connector having acceptable bearing components (which is not shown) about which the mast first member 32 may horizontally pivot. The mast pivot 34 is retained on the upper surface of the intermediate curved pad 28 by a pivot block 36. The pivot block 36 is configured as a rectangular retaining structures such as a pillow blocks. The pivot block 36 supports the pivot mast 34.

The mast first member 32 and the conjoined mast pivot 34 are preferably composed of a lightweight metal, such as aluminum. but other materials, such as a rigid structural plastic may be used. The pivot block 36 may be fabricated from any suitable material which may be affixed to the intermediate curved pad 28 by any acceptable means, such as threaded fasteners, or the like. The mast first block 52 is configured to be a generally cubic polyhedron composed of a similar constituent material as the mast first member 32. The mast first member 32 and the mast first block 52 may be cast, or forged, as a unitary piece, or conjoined by welding, or other thermal fabrication method.

The lap support 20 further includes a tilt bracket 38 and a tilt lever bar 46, which are capable of being placed in a plurality of secured relationships to affect the rotational angle between the lap support 20 and the central mast 30. The tilt bracket 38 is affixed to the upper face of the intermediate curved pad 28 preferably by welding. The tilt bracket 38 is provided with an aperture (not specifically shown) in which the end of the tilt lever bar 46 is disposed. The tilt bracket 38 is also provided with a tilt clamp collar 42 which is capable of supporting internal threads (not shown) for the engagement of the tilt adjustment screw 44. The tilt lever bar 46 projects from the front face of the mast first block 52. The tilt lever bar 46 has an arcuate distal end. Beneficially, the tilt lever bar 46 is attached to or is formed with the mast first block 52.

A plurality of circular tilt lever bar apertures 48 is disposed in the arcuate end of the tilt lever bar 46. The external threads (not enumerated) of the tilt adjustment screw 44 are engaged in the internal threads (not shown) of the tilt clamp collar 42 to secure the positional adjustment of the tilt lever bar 46 relative to the tilt bracket 38. Additionally, the tilt adjustment screw 44 is inserted into a respective tilt lever bar aperture 48 to maintain the desired attitude of the central mast 30. The tilt lever adjustment screw 44 may be provided with a fluted, or knurled, knob (not enumerated) to assist the user, or other operator, in making the necessary adjustments thereto.

The mast first block 52 provides support and an attachment point for the intermediate mast slide tube 54. The intermediate mast slide tube 54 is preferably a cylindrical tube composed of a lightweight metal, such as aluminum. The intermediate mast slide tube 54 is attached to the mast first block 52 by any acceptable method, such as welding. It can be seen by one skilled in the art that a multitude of methods could be used to attach the intermediate mast slide tube 54 to the mast first block 52.

As to best shown in FIG. 3 the intermediate mast slide tube 54 is inserted into the intermediate mast adjustment tube 56. A plurality of circular pin apertures 62 is longitudinally disposed along the intermediate mast adjustment tube 56. A first spring 58 is disposed in the intermediate mast slide tube 54 in proximity to an upper end. The first spring pin 58 is configured to be retained within an aperture (not shown) in the intermediate mast slide tube 54 and to project therefrom by means of a biasing spring (not shown). The first spring pin 58 is intended to further project from any selected pin aperture 62 of the engaged intermediate mast adjustment tube 56 to enable longitudinal adjustment of the intermediate mast slide tube 54 in a standard pin-and-aperture fashion. Other methods of implementing longitudinal adjustment may be utilized without limiting the scope of the supporting device 10. In addition, the positions of the intermediate mast slide tube 54 and the intermediate mast adjustment tube 56 along the length of the central mast 30 may be reversed.

The mast second block 64 is attached to an upper end of the intermediate mast adjustment tube 56. This attachment can be affected in the same manner as the previously discussed attachment between the mast first block 52 and the intermediate mast slide tube 54, or any variation thereof. The mast second block 64 is similar to the mast first block 52 in material and configuration. The mast second block 64 is provided with planar lateral faces (not enumerated) which may, or may not, be present on the mast first block 52.

Referring now to FIG. 1 and to FIG. 3, the cylindrical upper mast adjustment tube 102 is attached to an upper end of the mast second block 64 by any manner previously discussed. A plurality of pin apertures 62 is longitudinally disposed along the upper mast adjustment tube 102. The cylindrical upper mast slide tube 104 having a second spring pin 106 disposed therein is inserted into the upper mast adjustment tube 102. The second spring pin 106 and its configuration within the upper mast slide tube 104 is similar to the first spring pin 58 and serves a similar purpose of retaining a longitudinal adjustment between the upper mast tubes 102 and 104.

As illustrated in FIG. 2 the pivot first half 122 of a chin pad pivot 116 is attached to the upper end of the upper mast slide tube 104. The chin pad pivot 116 comprises the pivot first half 122 and a pivot second half 124 which are secured in a rotational relationship by a pivot clamp screw 126. The pivot clamp screw 126 passes through a central aperture (not shown) in the pivot second half 124 and is engaged in internal threads (not shown) which are disposed in the pivot first half 122. Rotational adjustment of the chin pad pivot 116 may be made by loosening the pivot clamp screw 126; altering the relationship between the pivot first half 122 and the pivot second half 124; and re tightening the pivot clamp screw 126. The pivot halves 122 and 124 are preferably composed of a lightweight metal, such as aluminum. The pivot clamp screw 126 may be provided with a fluted, or knurled, knob (not enumerated) to assist the user, or other operator, in making the necessary adjustments thereto.

The chin pad support block 114 is attached to a radial periphery of the pivot second half 124. The chin pad support block 114 is beneficially composed of a lightweight material similar to the constituent material of the pivot second half 124. The chin pad support block 114 has a planar cross-section shape compliant with attachment to the pivot second half 124 but to a more triangular shape to match a horizontal projection of a user's chin. The chin pad support block 114 beneficially has is provided with an over-covering chin pad 112. The chin pad 112 is cushioned and bound within a textile cover (not enumerated). The cover may be presented in any acceptable texture and color as may suit the purpose of the supporting device 10 and the taste of a user.

Figure 5:
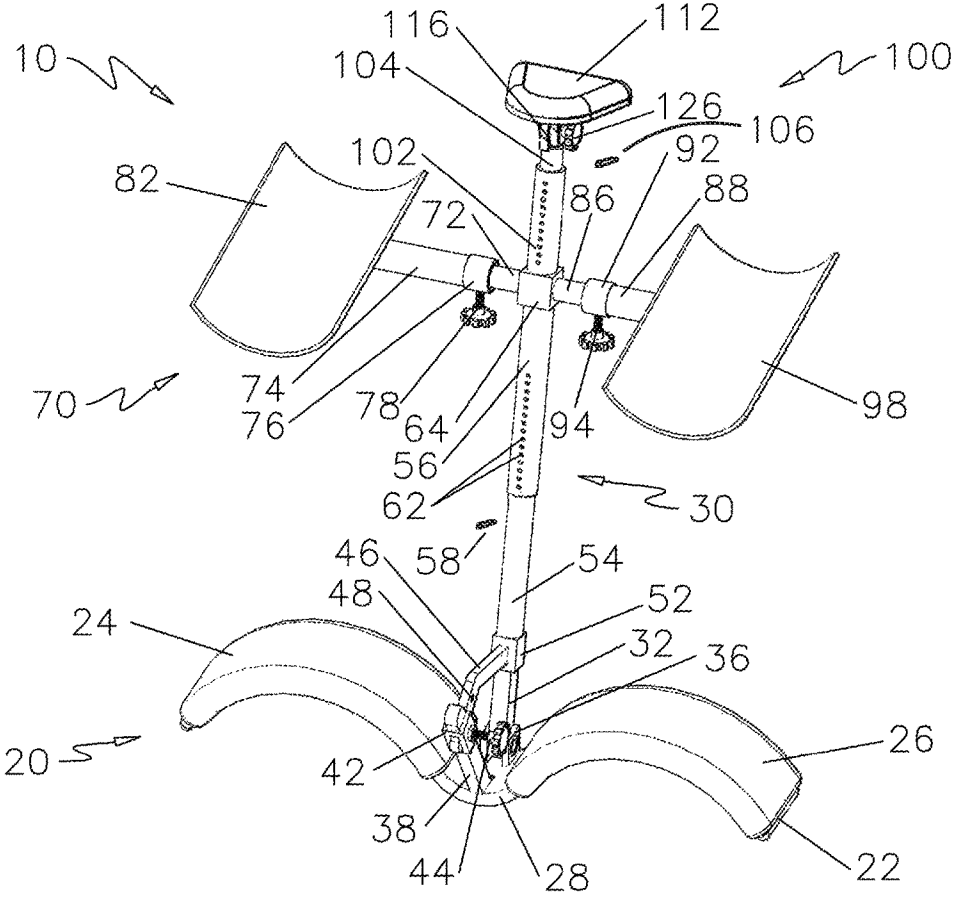

As best seen in probably FIG. 5, a first horizontal tube 72 and a second horizontal tube 86 are attached to the lateral faces of the mast second block 64. The horizontal tubes 72 and 86 are preferably cylindrical tubes welded to the mast second block 64 or attached by means of another thermal bonding procedure. In some embodiments the first horizontal tube 72 and the second horizontal tube 86 may be formed by opposite ends of the same tube that is appropriately inserted into an aperture (not shown) formed or drilled through the mast second block 64 so as to project equally from each lateral face. It can be understood that a multitude of methods could alternately be utilized for the attachment of the horizontal tubes 72 and 86 to the mast second block.

A first arm slide tube slidingly fits over the first horizontal tube 72. A first slide tube collar 76, configured as an annular ring having a sufficient thickness to support internal threads is disposed on a first end of the first arm slide tube 74. The external threads of a first arm adjustment screw 78 are engaged into the aforementioned internal threads in the walls (not enumerated) of the first slide tube collar 76 and the first arm slide tube 74. A first end of the first arm adjustment screw 78 bears against the first horizontal tube 72 to limit relative motion and to secure lateral and rotational adjustments.

Referring now also to FIG. 4, a first arm carrier bracket 84 is attached to a lower face of a first arm carrier 82 and to a distal end of the first arm slide tube 74. The first arm carrier 82 is an arcuate cradle, or trough, that is located approximately at the elbow or upper arm of the user and is intended to comfortably support the user's first arm and hand in a relaxed state.

A second arm carrier 96 is attached to a second arm carrier bracket 98, and a second arm slide tube 88 is engaged over the second horizontal tube to support the other arm and hand of the user. External threads of a second arm adjustment screw 94 engage with internal threads in the walls of a second slide tube collar 92. The second arm slide tube 88 secures the rotational and lateral adjustments of the second arm carrier 96. The adjustment screws 78 and 94 may be provided with a fluted, or knurled, knob (not enumerated) to assist the user, or other operator, in making the necessary adjustments thereto.

FIG. 5 presents a perspective view of the supporting device 10 in an exemplary tilted arrangement. In use the tilt adjustment screw 44 is rotated in to engage with the present tilt lever bar aperture 48; the central mast 30 is rotated in the desired direction until an alternate tilt lever bar aperture 48 is positioned in alignment with the tilt adjustment screw 44; and the tilt lever adjustment screw 44 is tightened in the selected position.

The preferred embodiment of the present invention can be utilized by a user in a simple and straightforward manner with little or no training. The following discussion of the method of using the supporting device 10 does not include any sanitizing steps between users or any statutory safety tests or examinations for compliance to fitness-for-use regulations.

After initial purchase or acquisition of the supporting device 10, it would be installed as indicated in FIG. 1. Those steps include acquiring a model of the supporting device 10; placing the leg pads 24 and 26 upon the upper legs of a seated user with the tilt bracket 38 facing away from the user; disengaging the first spring pin 58 from a respective pin aperture 62 in the intermediate mast adjustment tube 56 to properly adjust the vertical height of the mast second block 64 and the arm support 70 relative to the user; reengaging the first spring pin 58 into the alternated pin aperture 62; disengaging the second spring pin 106 from a respective pin aperture 62 in the upper mast adjustment tube 102 to properly adjust the vertical height of the chin pad 112 relative to the user; reengaging the second spring 106 into the alternate pin aperture 62; loosening the first arm adjustment screw 78; making a correct lateral and rotational positioning of the first arm carrier 82 to properly support the user's first arm; re tightening the first arm adjustment screw 78; loosening the second arm adjustment screw 94; making a correct lateral and rotational positioning of the second arm carrier 96 to properly support the user's second arm; re-tightening the second arm adjustment screw 94; loosening the pivot clamp screw 126; adjusting the chin pad pivot 116 as necessary to properly support the correct angle of the user's head; tightening the pivot clamp screw 126; and proceeding with the selected beautification procedure while the user relaxes comfortably on the supporting device 10.

An angular adjustment of the central mast 30 relative to the lap support 20 can be achieved by the previously stated procedure in order for the user to assume a more reclined position. A corresponding adjustment of the chin pad pivot 116 according to the previously stated procedure may be necessitated following an angular positioning alteration of the central mast 30.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An arm and chin support device, comprising:

a lap support having a base for resting on the lap of a user, said base including a first leg pad, a second leg pad, and an intermediate curved pad conjoining said first and second leg pads;

a length adjustable central mast pivotally attached to said intermediate curved pad;

an arm support movably adjustable along said central mast, said arm support including a tubular member and an arm carrier for supporting an arm of a user; and, a chin support pivotally attached to an upper end of said central mast.

2. The arm and chin support device according to claim 1 wherein said base is arcuate shaped.

3. The arm and chin support device according to claim 1 wherein said first leg pad is concave.

4. The arm and chin support device according to claim 3 wherein said first leg pad is cushioned.

5. The arm and chin support device according to claim 1, wherein said central mast includes:

a pivot block attached to said intermediate curved pad;

a mast pivot attached to said pivot block; and, a mast first member that pivots on said mast pivot relative to said intermediate curved pad.

6. The arm and chin support device according to claim 5, further including:

a tilt lever bar having a tilt lever aperture and which extends from said central mast;

a tilt bracket affixed to and extending from said intermediate curved pad and which receives said tilt lever bar; and, a tilt clamp collar having a tilt adjustment screw, said tilt lever clamp collar for selectively locking said tilt lever bar to said tilt bracket at a selected angle via said tile adjustment screw.

7. The arm and chin support device according to claim 6, further including a mast first block for coupling said central mast to said tilt lever bar.

8. The arm and chin support device according to claim 7, wherein said tilt lever has an arcuate end.

9. The arm and chin support device according to claim 7, further including an intermediate mast slide tube that extends upward from said mast first block.

10. The arm and chin support device according to claim 9, further including:

an intermediate mast slide tube aperture through said intermediate mast slide tube;

an intermediate mast adjustment tube having a pin aperture; and, a first spring biased pin which passes through said intermediate mast slide tube aperture pin aperture and through said intermediate mast slide tube aperture so as to interconnected said intermediate mast slide tube to said intermediate mast adjustment tube.

11. The arm and chin support device according to claim 9, further including a mast second block connected to said intermediate mast adjustment tube.

12. The arm and chin support device according to claim 9, further including an upper mast adjustment tube having a pin aperture and which extends upward from said mast second block.

13. The arm and chin support device according to claim 12, further including an upper mast slide tube having a pin aperture;

wherein said upper mast adjustment tube has a pin aperture and extends upward from said mast second block; and, a second spring biased pin which passes through said upper mast slide tube pin aperture and through said upper mast adjustment tube pin aperture so as to interconnected said upper mast slide tube and said upper mast adjustment tube.

14. The arm and chin support device according to claim 9, further including a rotatable chin pad pivot first half that is attached to said upper mast slide tube and a rotatable chin pad pivot second half that is also attached to said upper mast slide tube.

15. The arm and chin support device according to claim 14, further including a pivot clamp screw that passes through said chin pad pivot second half and into said chin pad pivot first half;

wherein said pivot clamp screw selectively locks said chin pad pivot second half and said chin pad pivot first half relative to said upper mast slide tube.

16. The arm and chin support device according to claim 15, further including a chin pad support block that is attached to said chin pad second half, said chin pad support block being covered by an over-covering chin pad.

17. The arm and chin support device according to claim 15, further including a first horizontal tube attached to said mast second block and a second horizontal tube attached to said mast second block.

18. The arm and chin support device according to claim 17, further including a first horizontal tube attached to said mast second block.

19. The arm and chin support device according to claim 18, further including:

a first arm carrier bracket attached to a said first arm slide tube; and, a first arm carrier attached to said first arm carrier bracket;

wherein said first arm carrier is configured to receive an arm of a user.

20. The arm and chin support device according to claim 19, wherein said first arm carrier forms an arcuate-shaped arm cradle.

* * * * *